US007080959B1

(12) United States Patent
Guerra et al.

(10) Patent No.: US 7,080,959 B1
(45) Date of Patent: Jul. 25, 2006

(54) ADJUSTABLE SCAFFOLD SHORING ACCESSORY

(76) Inventors: Rene A. Guerra, 11050 NW. 36th Ave., Miami, FL (US) 33167; Rene L. Guerra, 11050 NW. 36th Ave., Miami, FL (US) 33167

( * ) Notice: Subject to any disclaimer, the term of this patent is extended or adjusted under 35 U.S.C. 154(b) by 0 days.

(21) Appl. No.: 11/368,124

(22) Filed: Mar. 6, 2006

(51) Int. Cl.
*E04G 1/20* (2006.01)

(52) U.S. Cl. ..... 405/272; 405/288; 405/290; 182/182.2; 182/182.5; 182/186.6

(58) Field of Classification Search ..... 405/272, 405/288, 290; 182/181.1, 182.1, 182.2, 182.3, 182/182.4, 182.5, 186.6, 179.1
See application file for complete search history.

(56) References Cited

U.S. PATENT DOCUMENTS 5,980,160 A * 11/1999 Vanderklaauw ..... 405/288

6,871,454 B1 * 3/2005 Coday et al. ..... 182/186.6

* cited by examiner

*Primary Examiner*—Fredrick L. Lagman
(74) *Attorney, Agent, or Firm*—Sanchelima & Assoc., P.A.

(57) ABSTRACT

A shoring device that utilizes an accessory assembly mounted to a vertical tubular member of a tubular scaffold assembly to receive a shoring member therethrough. With an adjustable threaded ring mounted over the threaded portion of said accessory assembly, a supporting surface or edge is provided to a locking pin that passes through cooperating slots in the accessory assembly and radial through holes in the shoring post member to keep the post member and the accessory assembly at a fixed position with respect to each other. The lower most end of the threaded portion comes in abutting contact with the upper end of the scaffold vertical member thus transmitting the bearing load therethrough. A user can selectively adjust the effective length of the scaffold and shoring assemblies by rotating the ring assembly.

4 Claims, 3 Drawing Sheets

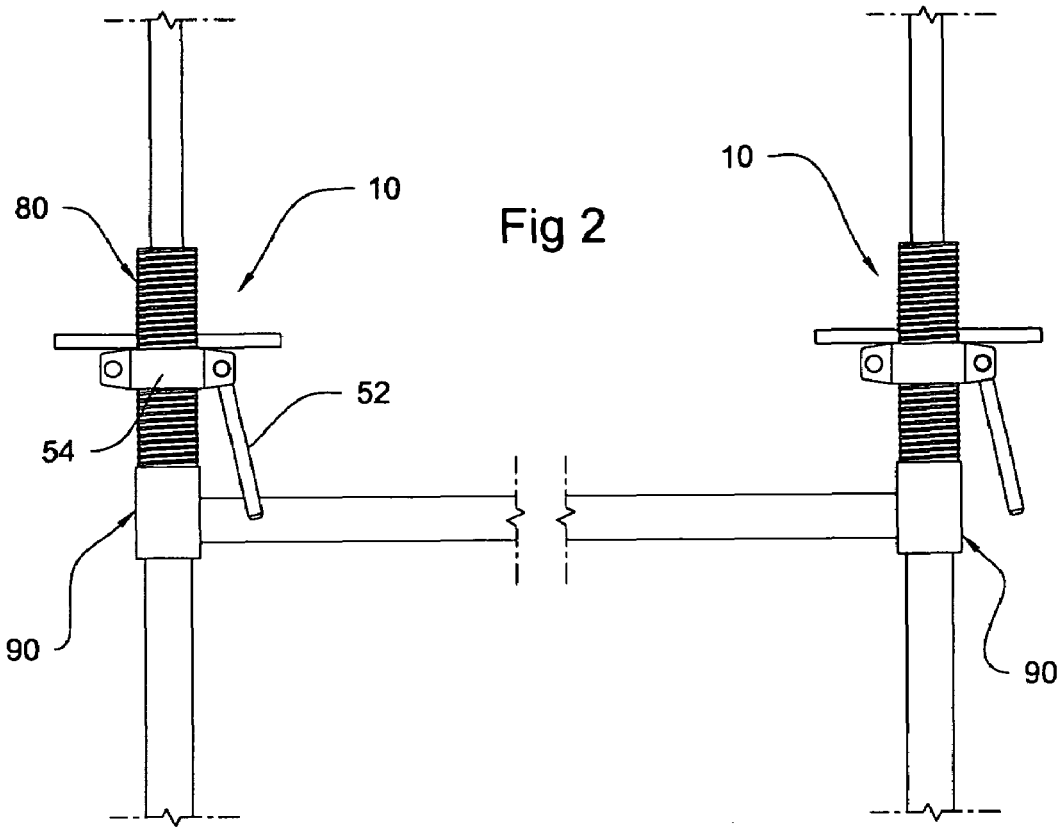
Fig 2
Fig 3
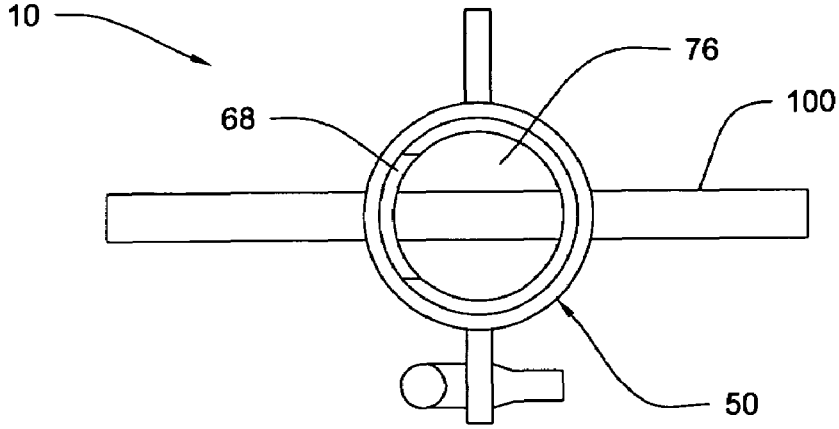

42
44
82
100
50
44
65
80
68
28
90
52
60
22
74
42

ADJUSTABLE SCAFFOLD SHORING ACCESSORY

BACKGROUND OF THE INVENTION

1. Field of the Invention

The present invention relates to shoring devices.

2. Description of the Related Art

Many shoring devices have been used in the past to temporarily hold a bearing load. A tubular shoring post is one of those devices. Typically, they include a mechanism for adjusting their effective height. Also, scaffolds are used in most construction sites to provide elevated surfaces for laborers and material. These scaffolds are typically removed when shoring is required, such as to support a slab being formed. The present invention is an accessory that extends the function of a tabular scaffold assembly as a shoring element utilizing a removable attachment. The attachments are removably and coaxially mounted as extensions to the upper ends of the vertical tubular members that receive therethrough elongated vertical posts. A locking mechanism permits a user to adjust the telescopically received vertical post to a desired effective height. Thus, doubling the function of scaffolding assemblies.

The logistic benefits of the present invention are evident since it eliminates the need to move and/or disassemble for storage the scaffolding assemblies when shoring is needed. In sites with limited space, such as tall buildings, this feature is quite desirable.

SUMMARY OF THE INVENTION

It is one of the objectives of the present invention to provide an accessory for conventional tubular scaffolding assemblies that permit the latter to function as a shoring device also.

It is another objective of this invention to provide such an accessory that is removable and compatible with existing conventional tubular scaffold assemblies and shoring posts.

It is yet another object of this invention to provide such a device that is inexpensive to manufacture and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which:

FIG. 2 shows an elevational view of the accessory assembly represented in FIG. 1 used with a tubular scaffold assembly and a shoring post assembly.

FIG. 3 illustrates a bottom view of the accessory shown in the previous figures.

DETAILED DESCRIPTION OF THE PREFERRED EMBODIMENT

Figure 1:
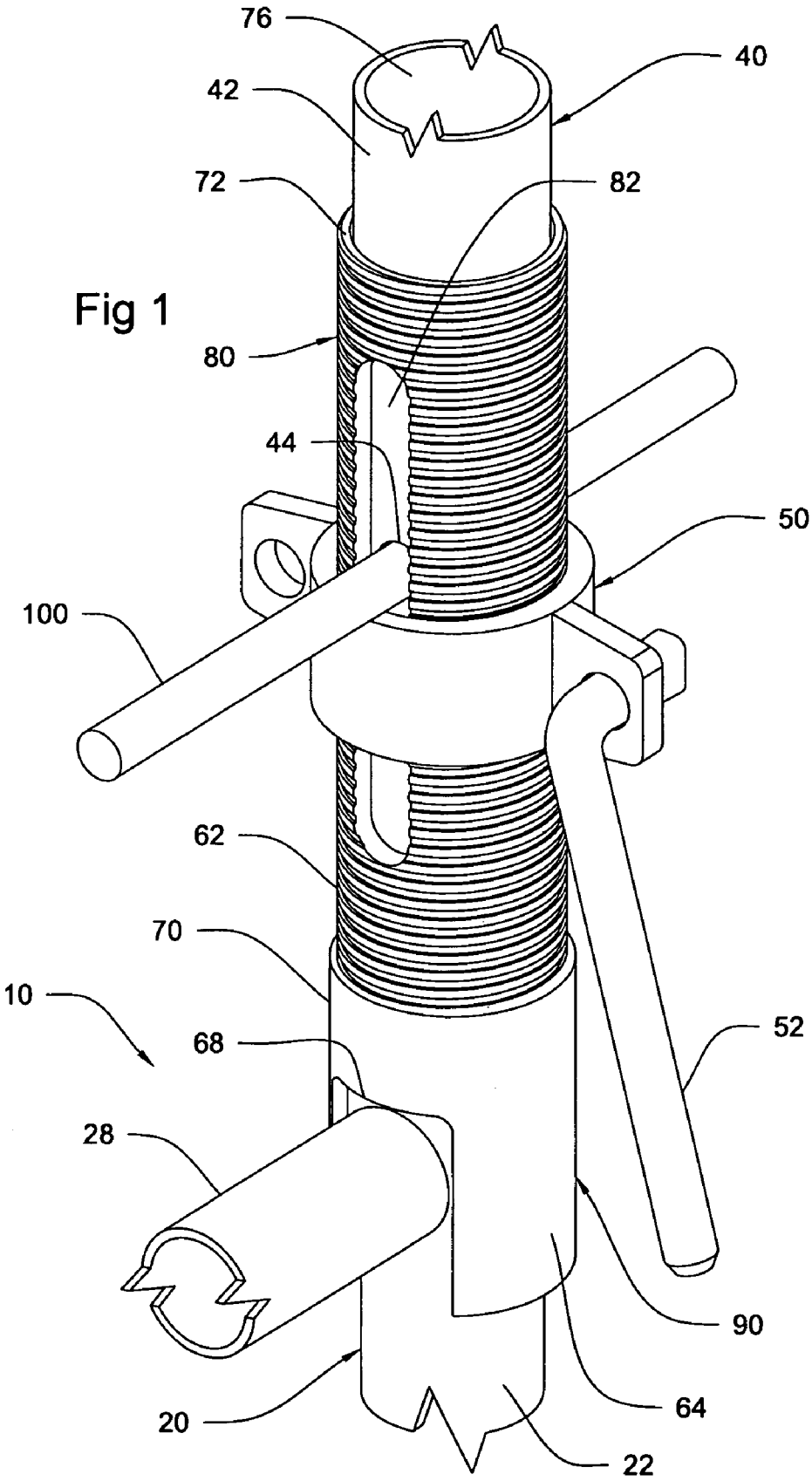
FIG. 1 is an isometric representation of a portion of a portion of a tubular scaffolding assembly with the accessory subject of the present invention mounted thereon and receiving a tubular shoring post member.
Figure 4:
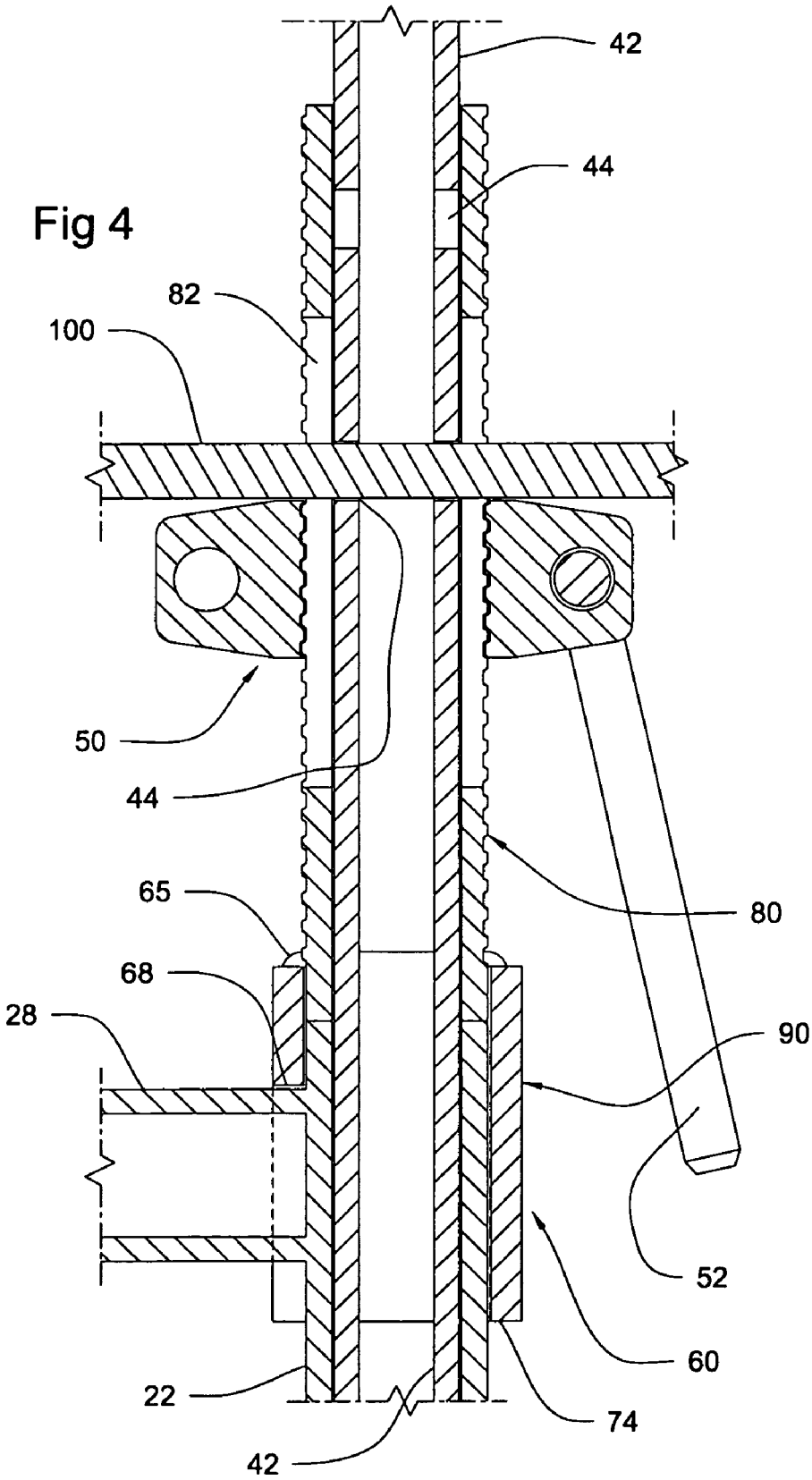
FIG. 4 is an elevational cross-sectional view of the accessory assembly shown in FIG. 2 taken along line 4—4.

Referring now to the drawings, where the present invention is generally referred to with numeral 10, it can be observed that it basically includes tubular scaffolding assembly 20, shoring post assembly 40 and accessory assembly 60.

Assembly 20 is a conventional tubular scaffold installation with elongated vertical tubular members 22 that are hollow at the upper end, as seen in FIGS. 1 and 2. These vertical members have a cooperative diameter to telescopically and coaxially receive conventional elongated shoring post members 42 of assembly 40. Members 42 include two ends, one of them is passed through accessory assembly 60 and partially received within tubular members 22. The other end comes in contact, typically through a plate, to the load that is supported.

Accessory assembly 60 has a substantially cylindrical body 70 with ends 72 and 74 and central through opening 76. Assembly 60 has a threaded portion 62 and a saddle portion 64. In the preferred embodiment, a peripheral solder line 65 keeps portions 62 and 64 rigidly together. Threaded portion 80 is adjacent to end 72 and extends a predetermined distance along cylindrical body 70. Saddle portion 90 is adjacent to end 74 and extends for the rest of cylindrical body 70. Threaded ring assembly 50 is compatible and mates with threaded portion 80, so that the former is allowed to travel axially along the latter's length. Its position can be adjusted therealong as desired. Saddle portion 64 has a cutout bay 68 that extends longitudinally from end 74.

Accessory assembly 60 receives member 42 through central opening 76 since the latter's diameter is smaller than the inner diameter of threaded portion 62. Threaded portion 62 includes elongated through slots 82, opposite to each other in the preferred embodiment, that extend a predetermined distance. Member 42 includes several through holes 44 radially passing there through with cooperating dimensions to receive locking pin 100. Locking pin 100 is sufficiently large to pass through slots 82, and one of through holes 44. Ring assembly 50 is selectively positioned along threaded portion 80 to coincide with slots 82 and to provide a support surface or edge for locking pin 100. The lower end of threaded portion 62 defines an inwardly extending step that comes in abutting contact in the upper end of member 22. Thus, the shoring bearing load is transmitted through member 42, to pin 100, to threaded portion 62 and directly to member 22. Handle 52 is provided to facilitate the rotation of ring assembly 50. By adjusting the position of ring assembly 50, a user can vary the effective length of the scaffold and shoring assemblies.

In use, a user mounts accessory 60, with ring assembly 50, on the upper end of vertical tubular member 22. One end of shoring post member 42 is inserted through accessory 60 and telescopically received within vertical member 22 at a desired position. One of the through holes 44 is selected and positioned within slot 82 and above the upper edge of ring assembly 50. Pin 100 is passed through one of the slots 82, through the selected hole 44 and through the opposite slot 82. Pin 100 rests on ring assembly keeping post member 42 at a fixed relative position with respect to vertical tubular member 22. Pin 100 needs to be sufficiently strong to withstand the resulting shear stress. Cutout bay 68 receives bracing member 28 and the bearing is thus transmitted to scaffolding assembly 20.

Then, a user rotates ring assembly 50 to extend the effective length of device 10 and perform the required shoring function.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A shoring device, comprising:

A) a scaffolding assembly including at least one tubular vertical member with an open upper end;

B) an accessory assembly having an elongated substantially cylindrical body with first and second ends, said body including a threaded portion having a first outer diameter and a first inner diameter adjacent to said first end and a saddle portion having a second inner diameter slightly larger than said first outer diameter to permit said threaded portion to partially penetrate inside said saddle portion to define an inward step that rests on said upper end and said saddle portion being adjacent to said second end, said threaded portion receiving said vertical member there through and, said saddle portion partially receiving a portion of said vertical member adjacent to said upper end, and said threaded portion including at least one longitudinally extending slot;

C) an elongated shoring member telescopically and partially receivable through said threaded and saddle portions, said shoring member including at least one cooperating radial through hole that is selectively aligned with at least one of said slots;

D) a ring assembly having an internal thread mating with said threaded portion and selectably positioned thereallong; and E) a locking pin having cooperative dimensions to lockingly engage with at least one of said slots and one of said at least one radial through hole, and resting on said ring assembly that in turn transmits the load through said threaded portion to said vertical member, so that in cooperation with said ring assembly permits a user to adjust the effective length of said scaffold and shoring assemblies.

2. The device set forth in claim 1, wherein said shoring member passes through said accessory assembly and is partially received inside said vertical tubular member.

3. The device set forth in claim 2, wherein said accessory assembly includes two slots that are opposite to each other and said locking pin passes therethrough.

4. The device set forth in claim 3, wherein said ring assembly includes a handle member to facilitate the rotation of the former.

* * * * *